United States Patent [19]

Schwab et al.

[11] 4,049,377

[45] Sept. 20, 1977

[54] DYEING AND PRINTING OF CELLULOSIC FIBERS OR MIXTURES OF CELLULOSIC FIBERS WITH SYNTHETIC FIBERS

[75] Inventors: Hermann Schwab; Adolf Blum, both of Ludwigshafen, Germany

[73] Assignee: BASF Aktiengesellschaft, Ludwigshafen, Germany

[21] Appl. No.: 691,496

[22] Filed: June 1, 1976

[30] Foreign Application Priority Data

June 27, 1975 Germany ..... 2528743

[51] Int. Cl.[2] ..... D06P 1/613

[52] U.S. Cl. ..... 8/169; 8/21 C; 8/85 A; 8/173

[58] Field of Search ..... 8/173, 85, 93, 169

[56] References Cited

U.S. PATENT DOCUMENTS

| | | | |
|---|---|---|---|
| 3,706,525 | 12/1972 | Blackwell et al. | 8/21 C |
| 3,711,245 | 1/1973 | Neumer | 8/21 C |

FOREIGN PATENT DOCUMENTS

| | | | |
|---|---|---|---|
| 723,526 | 12/1965 | Canada | 8/93 |

OTHER PUBLICATIONS

Casty, Amer. Dyestuff Rep., Dec. 12, 1960, pp. 105–117.

Karrer, Organic Chemistry, p. 102, Pub. 1938 by Elsevier, N.Y.C., 1938.

*Primary Examiner*—Donald Levy

*Attorney, Agent, or Firm*—Keil, Thompson & Shurtleff

[57] ABSTRACT

An improved process for dyeing or printing water-swellable cellulosic fibers and mixtures of said cellulosic fibers with synthetic fibers by contacting the fibers throughout with a dye liquor or print paste which contains, as essential ingredients, water in an amount sufficient to swell the cellulosic fibers, a water-insoluble disperse dye and a water-soluble solvent for the disperse dye such as polyethylene glycol or boric acid esters of polyethylene glycols, and heating the contacted fibers to fix the dye, the improvement comprising the addition of from 0.5 to 5% by weight, based on the dye liquor or print paste, of a condensate of an aliphatic monocarboxylic acid of from 8 to 20 carbon atoms and a primary or secondary hydroxyalkylamine of up to 6 carbon atoms, which condensate may be ethoxylated with up to 20 moles of ethylene oxide per mole of condensate.

6 Claims, No Drawings

DYEING AND PRINTING OF CELLULOSIC FIBERS OR MIXTURES OF CELLULOSIC FIBERS WITH SYNTHETIC FIBERS

This invention relates to a process for dyeing and printing cellulosic fibers or mixtures of cellulosic fibers with synthetic fibers with a dye liquor or print paste containing, as essential ingredients, a water-insoluble dye, a water-soluble swelling agent which is also a dye solvent, and water in an amount at least sufficient to swell the cellulosic fibers, wherein the swollen cellulosic fibers are contacted throughout, at some stage of the dyeing process, with a solution of the dye in the water-soluble dye solvent and the water-insoluble dye is fixed on the cellulosic fibers and any synthetic fibers present by heating to a temperature of not more than 225° C.

The process described above for dyeing cellulosic fibers or mixtures thereof with synthetic fibers is known from German Pat. No. 1,811,796. The dye yield obtained during dyeing is subject to strong fluctuations and could be improved upon. In particular, printing pastes stored for a number of days show a sharp drop in the dye yield during printing.

It is an object of the invention to increase the dye yield in the process described above and to improve the brilliance and, if possible, the fastness of the colorations.

This object is achieved, according to the present invention, by adding to the dye liquor or printing paste from 0.5 to 5% by weight of a condensate of aliphatic monocarboxylic acids of from 8 to 20 carbon atoms and primary or secondary hydroxylamines of up to 6 carbon atoms or reaction products thereof with up to 20 times the molar amount of ethylene oxide.

In the process of the invention, cellulosic fibers or mixtures of cellulosic fibers with synthetic fibers are printed or dyed. The cellulosic fibers must be swellable and suitable examples thereof are cotton, regenerated cellulose fibers which are sufficiently swellable in water, paper and wood cellulose. Where blends of fibers are used, suitable synthetic fibers are, in particular, fibers of polyester, cellulose triacetate, cellulose acetate and polyamides. The proportion of synthetic fibers in the fiber mixture may vary within wide limits. For example, fiber mixtures may be used which contain from 5 to 95% by weight of synthetic fibers.

Dyes suitable for the present process are those which are insoluble in water at temperatures of 60° C and above. For this reason, the dyes cannot be washed out of the dyed cellulosic fibers at said temperatures. Colored textiles are not generally washed at temperatures above 60° C. Dyes which are virtually insoluble in water at a temperature of 60° C are, for example, those of the following classes of dyes: anthraquinone dyes, azo dyes, indigo dyes, thioindigo dyes and phthalocyanine dyes. Examples of suitable dyes are as follows:

| | | |
|---|---|---|
| C.I. Disperse Yellow | 49 | (methine type dye) |
| C.I. Disperse Yellow | 50 | (azo type dye) |
| C.I. Disperse Yellow | 77 | (anthraquinone type dye) |
| C.I. Disperse Yellow | 99 | (methine type dye) |
| C.I. Disperse Yellow | 84 | (monoazo type dye) |
| C.I. Disperse Yellow | 31 | (methine type dye) |
| C.I. Disperse Yellow | 56 | (diazo type dye) |
| C.I. Disperse Orange | 38 | (diazo type dye) |
| C.I. Disperse Red | 167 | (azo type dye) |
| C.I. Disperse Red | 132 | (anthraquinone type dye) |
| C.I. Disperse Red | 92 | (anthraquinone type dye) |
| C.I. Disperse Violet | 29 | (anthraquinone type dye) |
| C.I. Disperse Violet | 40 | (monoazo type dye) |

-continued

| | | |
|---|---|---|
| C.I. Disperse Violet | 35 | (anthraquinone type dye) |
| C.I. Disperse Blue | 73 | (anthraquinone type dye) |
| C.I. Disperse Blue | 165 | (monoazo type dye) |
| C.I. Disperse Blue | 148 | (monoazo type dye) |
| C.I. Disperse Blue | 56 | (anthraquinone type dye) |
| C.I. Disperse Blue | 87 | (anthraquinone type dye). |

Water-soluble dye solvents are known from U.S. Pat. No. 3,706,525, which is incorporated herein by reference.

Examples of suitable water-soluble dye solvents which also act as swelling agents for cellulosic fibers (these substances being hereinafter referred to as dye solvents for the sake of brevity) are polyethylene glycols, polypropylene glycols and alkoxylation products of phenols, amines, thio compounds, alcohols such as ethylene glycol, glycerol, trimethylol propane, pentaerythritol and sorbitol, carbamates obtained by reaction of urea and polyalkylene oxides, for example compounds of the formula $$H-\left(O-\underset{\substack{|\\ C_nH_{2n+1}}}{CH}-CH_2\right)_m-O-\underset{\substack{\|\\ O}}{C}-NH_2$$

in which $n$ = 0 to 4 and $m$ = 1 to 25, and boric acid esters of which the alcohol component is derived from a monohydric to hexahydric alcohol of from 1 to 8 carbon atoms or an alkoxylation product thereof containing, per hydroxyl group, up to 20 ethylene oxide units and having a molar ratio of alcohol component to boric acid of from 0.5:1 to 5:1. We prefer to use boric acid esters as dye solvents.

The boric acid esters are prepared, for example, by esterification of boric acid with a monohydric to hexahydric alcohol of from 1 to 8 carbon atoms. Particularly suitable are alkoxylation products of monohydric to hexahydric alcohols of from 1 to 8 carbon atoms which contain up to 20 ethylene oxide units per hydroxyl group. The molar ratio of the alcohol component to boric acid is from 0.1:1 to 5:1 and preferably from 2:1 to 3:1. Suitable boric acid esters may also be prepared by reacting alkylene oxides of from 1 to 6 carbon atoms with o-boric acid in a molar ratio of from 5:1 to 1:1 and in the presence of aprotic organic solvents at temperatures of from 100° to 160° C or in the presence of catalytic amounts of bases or Lewis acids at from 70° to 120° C in a closed system at pressures of from 4 to 9 bars. Suitable aprotic organic solvents are, for example, acetone, dioxane, formamide, dimethyl acetamide and carbon tetrachloride. Examples of suitable bases are tertiary amines such as dimethyldodecylamine or catalytic amounts of sodium hydroxide or alkoxides such as sodium methoxide and potassium-t-butoxide. Particularly suitable Lewis acids are borofluoride etherate, aluminum chloride and zinc chloride.

The boric acid esters used may be those of $C_{1-8}$ alcohols $C_{2-8}$ diols, glycerol, trimethylolpropane, pentaerythritol, butanetriol and sorbitol. Particularly effective products are obtained if the said alcohols are subjected to an alkoxylation reaction prior to esterification with boric acid. In such alkoxylation, from 1 to 20 and preferably from 2 to 12 alkylene oxide units are added per hydroxyl group of the alcohol. The alkylene oxides mainly used are ethylene oxide and propylene oxide, but higher alkylene oxides such as the isomeric butylene oxides, cyclohexene oxide and hexamethylene oxide and mixtures of alkylene oxides may also be used. Di-, tri- and tetra-hydric alcohols are reacted, for example, with from 1 to 12 and preferably from 4 to 10 ethylene oxide units per hydroxyl group, whereas propylene oxide is usually employed in amounts of from 1 to 8 and preferably from 2 to 4 units per hydroxyl group of the alcohol. Preparation of the alkoxylation products may be effected using a mixed gas of ethylene oxide and propylene oxide so as to give random copolymers. The ratio of ethylene oxide to propylene oxide in such a mixed gas may vary within wide limits from, say, 1:99 to 99:1. The said alcohols or alkoxylated products are esterified with boric acid in known manner, for example by distilling off water in the presence of an entraining agent at temperatures of from 80° to 150° C or by reacting the components in the absence of a solvent in vacuo at temperatures of from 40° to 150° C.

The condensates of aliphatic monocarboxylic acids and primary or secondary hydroxylamines and their reaction products with ethylene oxide, as proposed for use in the present invention, are known per se. They may be formed, for example, from straight-chain or branched-chain, saturated or unsaturated carboxylic acids, for example capric, pelargonic, lauric, myristic, palmitic, stearic and oleic acids. Examples of primary or secondary hydroxy alkylamines are: monoethanolamine, diethanolamine, methylethanolamine and isobutylamine. According to the present invention, instead of said condensates their reaction products with up to 20 times the molar amount of ethylene oxide may be used. The ethoxylated products are more soluble in water but are not generally so effective as the condensates of carboxylic acids and hydroxyalkylamines. These products are used in amounts of from 5 to 50 parts per 1,000 parts of the dye bath or print paste, by weight. They may be directly added to the dye bath or print pastes and dispersed therein. For example, they may be dissolved in organic solvents, for example liquid aliphatic hydrocarbons such as naphtha, chlorinated hydrocarbons, aromatic hydrocarbons, monohydric or polyhydric alcohols which may also contain ether groupings, for example ethanol, ethylene glycol, diethylene glycol, butyl triglycol, glycerol, glycol, monomethyl ether, methanol, butanol, monophenyl glycol, or ketones such as acetone, and then dispersed in the dye baths or print pastes in this form. Alternatively, the above agents may be dissolved in one or more of the aforementioned dye solvents and the mixture then added to the padding liquor or print paste.

Surprisingly, stable printing pastes and higher dye yields on the cellulose fibers are obtained especially when the above agents are first stirred into the thickener and then one or more dye solvents are added.

1,000 parts of the liquor usually contain from 50 to 900 parts of water, from 1 to 100 parts of water-insoluble dye, from 50 to 200 parts of the water-soluble dye solvent and from 5 to 50 parts of one or more of said agents, by weight. The printing pastes differ from the padding liquors in that they additionally contain a natural or synthetic thickener and a correspondingly smaller amount of water. The amount of thickener contained in the printing pastes is from 10 to 100 parts per 1,000 parts of printing paste, by weight. Suitable natural thickeners are, for example, carob flour, starch ether, alginates, starch, tragacanth, carboxymethyl cellulose and cellulose ether. Examples of suitable synthetic thickeners are copolymers of acrylic or methacrylic acid with ethylenically unsaturated comonomers having two double bonds, for example butadiene, hydroxyalkyl acrylates, hydroxyalkyl methacrylates, divinyl dioxane and divinyl benzene. These thickeners contain from 95 to 99.5% of acrylic or methacrylic acid. Also suitable are thickeners which additionally contain polymerized units of other comonomers, copolymers of acrylic or methacrylic acid with ethylenically unsaturated compounds such as alkyl acrylates, alkyl methacrylates, vinyl esters and copolymers of maleic anhydride, styrene and ethylene. In order to achieve sufficient thickening of the print paste, it is necessary to use the thickeners in the form of their alkali metal or ammonium salts. The copolymers are therefore partially or completely reacted with bases. We prefer to use, as bases, ammonia or amines such as morpholine, mixtures of ammonia and amines and caustic soda and caustic potash. The pH is preferably between 5 and 11.

Cellulose fibers or mixtures thereof with synthetic fibers are dyed or printed by contacting the fibers with the aforementioned padding liquors or print pastes and fixing the dye by means of hot air or superheated steam. However, the temperature should not exceed 225° C. Fixation is generally carried out at temperatures between 70° and 220° C. Cellulose fibers or mixtures thereof with synthetic fibers may also be dyed by first allowing the cellulose fibers to swell in water and then applying the mixture of dye solvent, dye and the agent of the invention to the fibers. Alternatively, the said agent and dye solvent may first be applied to the fiber, after which the water and water-insoluble disperse dye are applied. In the dyeing and printing process of the invention, it is merely important for the interior of the swollen cellulose fibers to be contacted with a solution of the dye in the water-soluble dye solvent, the agent to be used in accordance with the present invention and water, at some stage of the process. During fixation, the water is removed from the fibers.

The dye solvent is preferably a polyglycol ether having a molecular weight of from 100 to 800, a boric acid ester of polyglycol having a molecular weight of from 300 to 3,000 and in which the molar ratio of the alcohol component to the boric acid is from 2:1 to 3:1, or a reaction product of polyglycol (molecular weight from 100 to 800) and urea in a molar ratio of about 1:1.

There are obtained, surprisingly, stable dye liquors and print pastes which provide, even after storage over a long period, colorations and prints showing a high dye yield.

The invention is described below with reference to the following Examples in which the parts and percentages are by weight.

EXAMPLE 1

A print paste of the following composition is printed onto a cotton fabric:

| | |
|---|---|
| 870 parts | of alginate thickener (3% of alginate + 97% of water) |
| 30 parts | of oleic acid diethanolamide |
| 90 parts | of polyethylene glycol having a molecular weight of 200 |
| 10 parts | of 1-amino-4-nitrobenzene-1-aminonaphthalene-N,N-diethyl-m-toluidine |
| 1000 parts | |
| 1000 parts | |

The printed fabric is dried and treated for 1 minute with hot air at 200° C, rinsed, soaped and rinsed. There is obtained a navy blue print on a white ground.

EXAMPLE 2

A fabric of 67:33 w/w polyester/cellulose is printed with the following print paste:

| | |
|---|---|
| 870 parts | of alginate thickener (3% of alginate + 97% of water) |
| 30 parts | of oleic acid monoethanolamide |
| 90 parts | of polyethylene glycol having a molecular weight of 300 |
| 10 parts | of the yellow dye C.I. Disperse Yellow 6G (azo type dye) |
| 1000 parts | |

The printed and dried fabric is treated for 6 minutes with superheated steam at 180° C, rinsed, soaped and rinsed. There is obtained a brilliant yellow print on a white ground.

EXAMPLE 3

A print paste of the following composition is printed onto a 67:33 w/w cotton/polyester fabric:

| | |
|---|---|
| 870 parts | of alginate thickener (3% of alginate + 97% of water) |
| 30 parts | of oleic acid diethanolamide |
| 90 parts | of the reaction product obtained by adding 6 moles of ethylene oxide to 1 mole of glycol and esterifying with boric acid in a molar ratio of 3:1 |
| 10 parts | of Disperse Yellow C.I. 49 (methine type dye) |
| 1000 parts | |

The printed fabric is dried at 120° C and then treated for 6 minutes with superheated steam at 180° C and rinsed. There is obtained a yellow print on a white ground.

EXAMPLE 4

A cotton fabric is printed with a print paste of the following composition:

| | |
|---|---|
| 870 parts | of alginate thickener (3% of alginate + 97% of water) |
| 20 parts | of oleic acid diethanolamide |
| 100 parts | of the reaction product of polyglycol of molecular weight 300 and urea in a molar ratio of 1:1 |

-continued

| | |
|---|---|
| 10 parts | of C.I. Disperse Violet 29 (anthraquinone type dye) |
| 1000 parts | |

The printed fabric is dried at 100° C and then treated with hot air for 45 seconds at 225° C, rinsed, soaped and rinsed. There is obtained a violet print on a white ground.

We claim:

1. An improved process for dyeing or printing water-swellable cellulose fibers and mixtures of said cellulosic fibers with synthetic fibers by contacting the fibers throughout with a dye liquor or a print paste which contains, as essential ingredients, water in an amount sufficient to swell the cellulosic fibers, a water-insoluble disperse dye and a solvent for the disperse dye selected from the group consisting of boric esters of polyalkylene oxides, and heating the contacted fibers to effect fixation of the dye wherein the improvement comprises adding 0.5 to 5% by weight, based on the dyeing liquor or print paste, of a condensate of an aliphatic monocarboxylic acid of from 8 to 20 carbon atoms and a primary or secondary hydroxyalkylamine of up to 6 carbon atoms, which condensate may be ethoxylated with up to 20 moles of ethylene oxide per mole of condensate.

2. An improved process as claimed in claim 1, wherein the boric acid ester of the alcohol of from 1 to 6 hydroxyl groups and from 1 to 8 carbon atoms has the molar ratio of alcohol to boric acid being from 0.5:1 to 5:1.

3. An improved process as claimed in claim 1, wherein the boric acid ester is a reaction product of the alcohol with an alcohol of from 1 to 6 hydroxyl groups and from 1 to 8 carbon atoms and ethylene oxide, which reaction product contains, per hydroxyl group, from 1 to 20 ethylene oxide units, the molar ratio of the alcohol component to boric acid being from 0.5:1 to 5:1.

4. An improved process as claimed in claim 1, wherein the borate ester is the reaction product of an alkylene oxide of from 1 to 6 carbon atoms with boric acid in a molar ratio of from 5:1 to 1:1.

5. An improved process as claimed in claim 1, wherein a condensate of oleic acid and ethanolamine is used.

6. An improved process as claimed in claim 1, wherein a condensate of oleic acid and diethanolamine is used.

* * * * *